US005647506A

United States Patent [19]

Julius

[11] Patent Number: 5,647,506

[45] Date of Patent: Jul. 15, 1997

[54] READILY OPENABLE POP-UP DISPENSER FOR MOIST TISSUES

[75] Inventor: Robert P. Julius, Greenwich, Conn.

[73] Assignee: Nice-Pak Products, Inc., Orangeburg, N.Y.

[21] Appl. No.: 450,493

[22] Filed: May 26, 1995

[51] Int. Cl.[6] ..... A47K 10/24

[52] U.S. Cl. ..... 221/46; 206/449

[58] Field of Search ..... 221/33, 45, 46, 221/48, 63; 206/449, 494, 812

[56] References Cited

U.S. PATENT DOCUMENTS

| | | | |
|---|---|---|---|
| 3,780,980 | 12/1973 | Fitzpatrick et al. | 221/48 |
| 3,836,045 | 9/1974 | Duhy et al. | 221/63 |
| 4,156,493 | 5/1979 | Julius | 221/63 |
| 4,420,080 | 12/1983 | Nakamura | 206/449 |
| 4,735,317 | 4/1988 | Sussman et al. | 206/449 |
| 4,848,575 | 7/1989 | Nakamura et al. | 206/449 |
| 4,863,064 | 9/1989 | Dailey, III | 221/48 |
| 5,040,680 | 8/1991 | Wilson et al. | 206/459 |
| 5,344,007 | 9/1994 | Nakamura et al. | 206/205 |

FOREIGN PATENT DOCUMENTS

WO93/17933 9/1993 WIPO .

*Primary Examiner*—Kenneth Noland

*Attorney, Agent, or Firm*—Lerner, David, Littenberg, Krumholz & Mentlik

[57] ABSTRACT

A resealable dispenser for dispensing a plurality of interleaved, individual moisture-impregnated articles, such as moist tissues, includes a housing having sufficient rigidity to retain its shape subsequent to its manufacture, side and a unitary top wall having a substantially planar outer surface and a recessed portion provided with an orifice for removing individual moist tissues from the housing through the orifice. The recessed portion is formed to accommodate a portion of one of the moist tissues projecting from said orifice so as to allow pop-up dispensing. A resealable flexible label is attached to the outer surface of said top wall and completely covers the recessed portion whereby moist tissues can be individually removed from the housing such that subsequent tissues are drawn into a removal position with a portion of the next tissue remaining within the recess. The flexible label can be resealably sealed to the outer surface of the top wall when a subsequent tissue is in its pop-up, removal position.

31 Claims, 3 Drawing Sheets

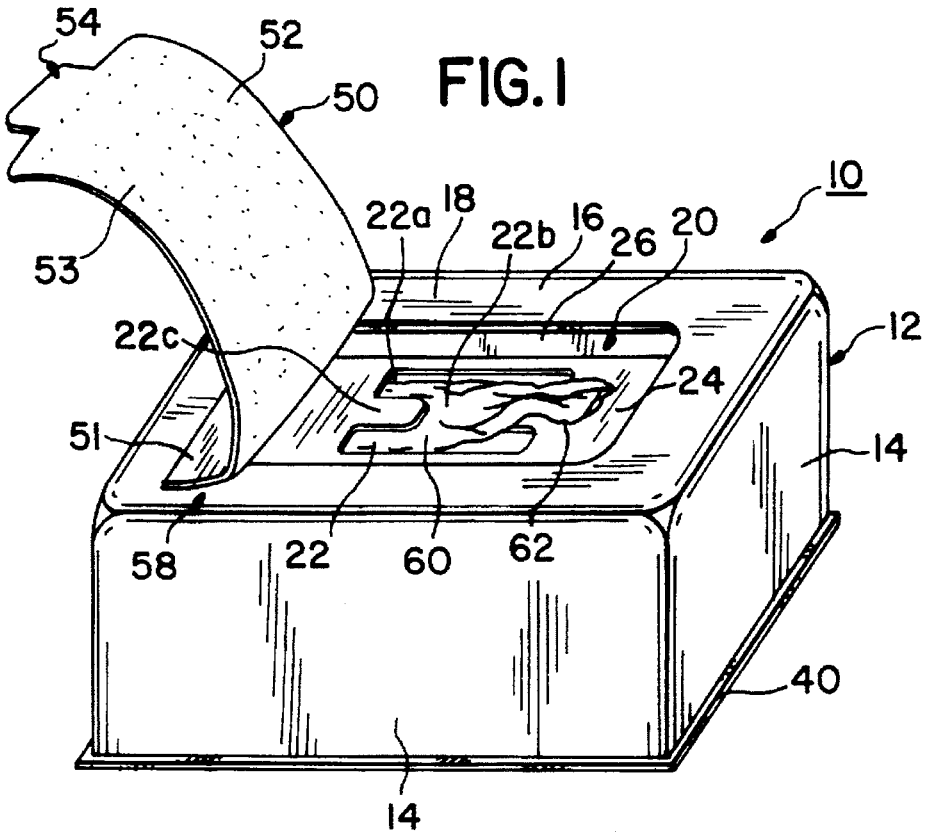
FIG. 1
FIG. 2
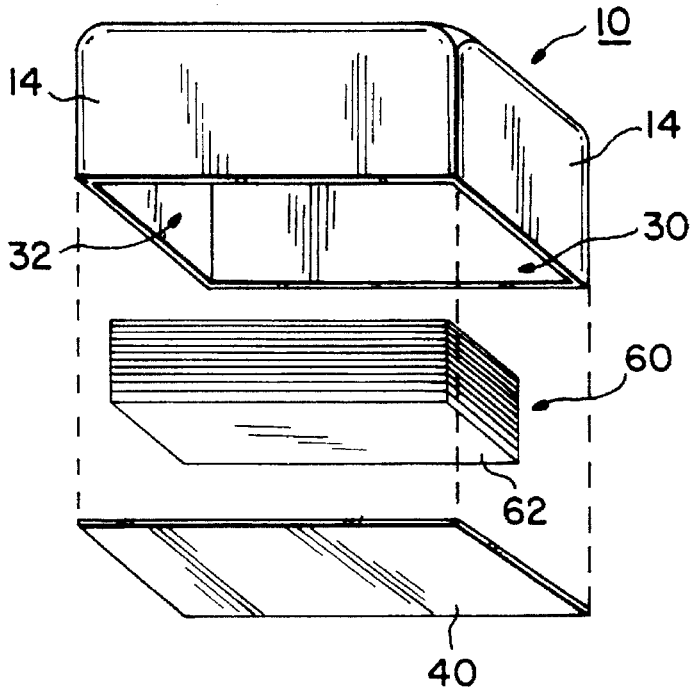

READILY OPENABLE POP-UP DISPENSER FOR MOIST TISSUES

FIELD OF THE INVENTION

The present invention relates to readily openable and resealable dispensers for dispensing individual moisture-impregnated tissues, and more particularly to such dispensers wherein the tissues are dispensed from the container in a pop-up fashion.

BACKGROUND OF THE INVENTION

There is nothing more frustrating to a parent than trying to hold and steady her infant with one hand while at the same time trying to open up a moist tissue dispenser and pull out the tissues with the other hand. This is not only awkward and aggravating, but sometimes is impossible to accomplish due to the construction of the moist tissue dispenser.

It is better for both the parent and the infant if the parent can simply and easily open up a moist tissue dispenser with one hand and also pull out subsequent tissues with only one hand. For the parent, aggravation and frustration are greatly reduced if the moist tissue can be retrieved from the dispenser while the parent is performing the delicate balancing act of holding the child, opening the dispenser, pulling out a moist tissue, cleaning the child, closing the dispenser, and then reopening the dispenser and pulling out another tissue, and possibly even repeating these steps as necessary. For the child, if the parent can open the dispenser and retrieve the moist tissue with only one hand, safety is increased since the parent can use the other hand to hold and steady the child so the child is less likely to crawl off a changing table or slip from the arms of the parent.

There is, however, something beyond fumbling to both open a moist tissue dispenser and pull out a tissue with only one hand while holding a child with the other hand which is also a cause of frustration. That further source of difficulty is the cost of buying the reusable, refillable moist tissue dispenser and subsequent refill packs. To this end, the parent typically must first buy a reusable moist tissues container, which can be quite expensive since they are made from a sturdy, hard plastic so as to be sufficiently durable. Then, after using up the initial supply of moist tissues which are usually provided with the reusable container, the parent must then purchase separate disposable refill packs. Moreover, to add to the frustration, the parent is oftentimes forced to buy replacement reusable containers when the top to the original container is lost, or the hinges break off, or when it accidentally becomes a chew toy for the family pet.

Frustration and anger can peak when the parent is performing the difficult and thankless task of changing the child and the last moist tissue in the dispenser is used up while more tissues are still required. In this case, a refill pack must be retrieved, the reusable container has to be opened, the packaging for the refill pack must be removed, and the dispenser must be refilled. If the dispenser provides for pop-up dispensing, the pop-up aperture, usually provided in a separate tray member, must also be threaded with the first tissue after the tray member is placed over the stack of tissues. No one should be placed in such annoying and frustrating dispensing situations, particularly parents who, after working a full day, are tired, stressed-out, over-worked, and are raising their families on a limited budget.

Parents and other consumers over the years have been provided with a multitude of so-called "improved" dispensers which, nevertheless, have provided little relief from the above dispenser-related problems. For instance, Nukamura et al., U.S. Pat. No. 4,848,575, discloses a resealable container for dispensing wet tissues which includes a container body and a separate tray member provided between the wet tissues and the top surface of the container. The container is formed from a flexible film and the tray member is made of a material which is relatively harder than the material of the container. Similarly, Dailey III, U.S. Pat. No. 4,863,064, discloses a flexible container with a semi-rigid insert located within the container to provide structural reinforcement to the packet. These container arrangements are costly to manufacture since they provide inner trays that must be not only be separately formed, but which also must be placed within the container. The extra manufacturing steps lead to increased costs which are ultimately passed on to the consumer.

Sussman et al., U.S. Pat. No. 4,735,317, provides a self-sealing dispenser pack for pre-moistened towelettes in which a separate package of replaceable pre-moistened towelettes is contained with in the dispenser. The dispenser is intended to be re-usable and not disposable. The rigid container, molded from resilient plastic, includes a recessed cavity which is accessed by opening a resilient sheet lid. The resilient lid is also preferably formed of plastic material and has the same dimensions as the recessed cavity therebelow such that it can sealingly fit, by interference holding, with the area defined by the riser walls of the cavity. The unsecured or free end of the lid is provided with a tab that is held in place within a recessed area which can accommodate a finger to facilitate the lifting of the tab from the recess. The construction of this dispenser pack is also rather complicated, since the resilient lid must not only be formed with the proper dimensions to fit snugly within the riser walls and tab recess area, but it must also be attached to the container itself, for instance by heat sealing. Furthermore, since this container is formed from resilient plastic material and is reusable, it is also more expensive to manufacture as compared to disposable containers made of thinner, semi-rigid or soft plastic material.

Fitzpatrick et al., U.S. Pat. No. 3,780,908, discloses a container for dispensing moist sheets which includes a semi-rigid or rigid container produced by molding or vacuum forming of a suitable plastic such as polypropylene. However, a separate top member is provided comprising an insert which is snapped within the container below the rim of the insert. The insert itself includes depending rib members and is stabilized upon posts provided within the box. This container also requires a separate hinged cover in order to provide a space between the insert and the cover to accommodate the end of the next available wet tissue. Similar to the above-described containers, this container is also expensive to manufacture given not only the need to provided separate plastic pieces, but also because of the relative complexity of the snap-fit insert and hinged lid arrangement.

Nakamura, U.S. Pat. No. 4,420,080, discloses a number of resealable dispenser containers, most of which are made entirely from a flexible film. These all-film containers provide some advantages, such as their low cost to manufacture, but at the same time create considerable difficulties when trying to provide a pop-up dispenser which allows removal of a tissue with the use of only one hand. As explained above, one-handed removal of a tissue can be very important, especially when the tissue is being used for an infant which typically must be held or supported with one hand. This leaves only one hand free for opening the container and removing the tissue. Soft, thin, flexible film containers, however, are not designed for one-handed removal of the tissues. First, because they are made form a flexible film material, they cannot alone provide a well or recess in the top surface for pop-up removal and air-tight storage of a top portion of the next dispensed tissue in such a recess. Second, these flexible film containers do not provide a rigid or semi-rigid surface on which to rest the side of one's hand for easy opening with one hand. Thus, attempts at one-handed tissue removal will place undue pressure on the other tissues beneath the hand as the hand is pressed down on the dispenser.

In one embodiment of Nakamura, U.S. Pat. No. 4,420,080, a separate body part is provided which can be formed from a molded plastic material. However, the main body portion, which includes an opening therein, is still made from a film material and therefore also suffers the shortcoming of not being able to provide a rigid dispensing well for pop-up dispensing for storage of a top portion of the next dispensed tissue.

U.S. Pat. No. 4,156,493 to the present applicant discloses a recloseable dispenser packet for moisture impregnated towelettes employing a resealable closure whereby the packet may be opened and thereafter closed to maintain the packet in a hermetically sealed condition. This dispenser is particularly useful for storing a small number of towelettes convenient for carrying in a pocket or purse. However, like U.S. Pat. No. 4,420,080 to Nakamura, this container does not provide for pop-up dispensing of the towelettes.

Duhy, U.S. Pat. No. 3,836,045, discloses a rigid container, in which the container is covered by a cover sheet followed by a removable inner lid.

Wilson et al., U.S. Pat. No. 5,040,680, discloses another dispensing container, in this case including adhesive foil covering an opening, followed by thermal formed lid and adhesive substrate for closing same.

Nakamura et al., U.S. Pat. No. 5,344,007, discloses yet another resealable package having a jar-like container with a screw top closure. This patent also discloses a container with a flat top formed from a rigid, semi-rigid or flexible material with a resealable flap affixed thereto. This patent is particularly directed to the use of liquid barrier sheets interposed in the stack between the wet absorbent sheets.

Finally, Deflander et al., International Publication No. WO93/17933, recognizes the desirability of providing a dispensing device which permits one-handed usage. However, in this case the patentees disclose the use of a flexible pouch 5 within a rigid container 3, with a lid 12, and in which means such as tapes 27, 29, and velcro 37 are provided to anchor the pouch within the container, or to anchor the container to a flat surface.

All of the aforementioned containers have, in one way or another, failed to provide a dispenser that meets the needs, expectations and hopes of consumers, especially parents who simply do not want to face insurmountable challenges to their dexterity when trying to open a dispenser and retrieve moist tissues with only one hand, and also furthermore wish to do so on a financially reasonable basis. Thus, these past dispensers have not succeeded in providing a low-cost, simply-constructed, recyclable, disposable, pop-up, wet tissue dispenser, which is capable of being opened and resealed with one hand, tissues removed, and resealed with a single hand so as to allow free use of the other hand.

SUMMARY OF THE INVENTION

The aforementioned shortcomings of moist tissue dispensers have been addressed by the present invention, which in one aspect provides a resealable dispenser for dispensing individual moisture-impregnated articles, such as moist tissues or napkins, from a plurality of interleaved tissues. The dispenser includes a housing with sufficient rigidity to retain its shape after it is manufactured, and includes depending side walls for retaining a supply of the moisture-impregnated articles therein and a top wall having a substantially planar outer surface and a recessed portion. Preferably, the top wall is a single layer of material, and the housing of the dispenser is formed from a semi-rigid thermoplastic, such as a polyolefin, etc. In one embodiment, the substantially planar outer surface comprises the entire top wall of the housing. The recessed inner portion includes an orifice for removal of individual moisture-impregnated articles from the housing through the orifice and has a size that is sufficient to accommodate a portion of one of the moisture-impregnated articles projecting from the orifice. In a preferred embodiment, the entire top wall, including the recessed portion, is a unitary member.

The dispenser further includes supply means comprising an opening in the housing for supplying a plurality of the moisture-impregnated articles into the housing subsequent to its manufacture. Preferably, the opening is provided on the bottom the housing and more preferably comprises the entirety of said bottom. The dispenser further includes sealing means for sealing the supply means after supplying the moisture-impregnated articles into the housing, and a resealable flexible label attached to the substantially planar outer surface of the top wall of the housing. The sealing means preferably comprises a thin film covering which provides the bottom wall for the housing. The label is provided with a size sufficient to completely cover the recessed portion. The dispenser is arranged such that the moisture-impregnated articles can be individually removed from the housing, drawing a subsequent moisture-impregnated article into the removal position with a portion of the article within the recessed portion. The resealable label can be resealably sealed to the outer surface of the top wall with a subsequent moisture-impregnated article in the removal position.

In one embodiment of the dispenser, the recessed portion includes a die-cut base portion, and access means, such as a hinge for displacing the die-cut base portion and providing access to the interior of the housing. Preferably, the access means includes temporary locking means, such as projections extending from the side walls of the recessed portion, for temporarily locking the die-cut base portion in position during use. In another embodiment, the base portion of the recessed portion is separate from the recessed portion, and the access means includes the above-described temporary locking means.

In accordance with another aspect of the present invention, a method of manufacturing the resealable dispenser is provided. The method includes the steps of:

(a) forming a housing having depending side walls and a unitary top wall having a substantially planar outer surface and a recessed portion including an orifice for removal of the individual moisture-impregnated articles from the housing through said orifice, the recessed portion having a size sufficient to accommodate a portion of one of the moisture-impregnated articles projecting from the orifice and the housing being formed from a material having sufficient rigidity so that the housing retains its shape subsequent to its formation;

(b) supplying the moisture-impregnated articles to the housing through an opening in the housing after the step of forming the housing;

(c) sealing the opening in the housing after the step of supplying the moisture-impregnated articles into the housing; and (d) attaching a resealable flexible label to the substantially planar outer surface of the top wall of the housing, the label having a size sufficient to completely cover the recessed portion, whereby the moisture-impregnated articles can be individually removed from the housing, drawing a subsequent moisture-impregnated article into the removal position with a portion of the article within the recessed portion, and the resealable label can be resealably sealed to the outer surface of the top wall with the subsequent moisture-impregnated article in the removal position.

BRIEF DESCRIPTION OF THE DRAWINGS

FIG. 1 is a front perspective view of a resealable dispenser in accordance with a preferred embodiment of the present invention.

FIG. 2 is an exploded, bottom perspective view of the dispenser shown in FIG. 1.

DETAILED DESCRIPTION OF A PREFERRED EMBODIMENT

Figure 3:
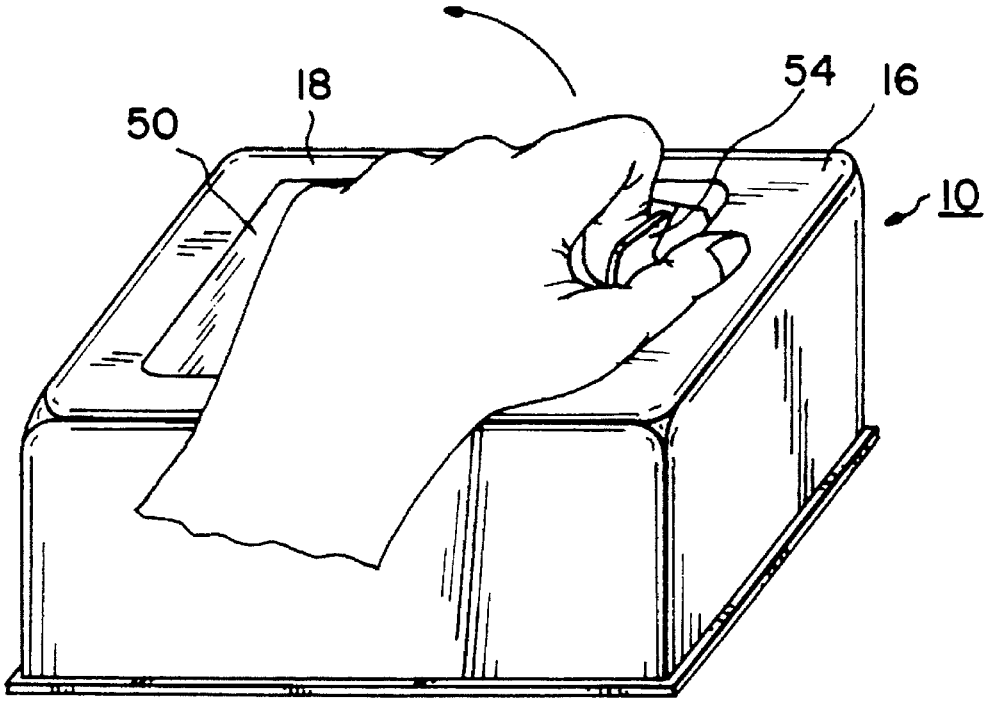
FIG. 3 is a front perspective view illustrating the initial opening of the dispenser of FIG. 1.

Referring to FIGS. 1 and 2, there is illustrated a preferred embodiment of a resealable dispenser generally designated as 10. The dispenser 10 is preferably rectangular in shape and includes a housing 12 having depending side walls 14 extending downwardly from and transverse to a unitary top wall 16. Top wall 16 includes a substantially planar outer surface 18 and a recessed portion 20 integrally formed therein.

Housing 20 is formed from a material having sufficient rigidity so as to keep its shape once it is formed. To this end, housing 20 is preferably formed from a material which will provide moisture vapor protection for the wet sheets therein, and most particularly a semi-rigid post-consumer thermoformed recycled plastic, including polyolefins, such as polyethylene and polypropylene, and polyimides. Although housing 10 is illustrated as rectangular, other shapes and forms can be used according to consumer preference and/or the particular type of moisture-impregnated article being dispensed. For dispensing items such as baby wipes, the dimensions of the dispenser are approximately 4.5" wide, 7" long and 3.5" high, which accommodates standard size baby wipes.

Recessed portion 20, which is integrally formed in top wall 16, includes a recessed bottom wall 24 extending substantially parallel to outer surface 18, and recessed side walls 26 which extend circumferentially about bottom wall 24. Recessed side walls are substantially parallel to side walls 14 and perpendicular to outer surface 18. Recessed portion 20 includes an orifice 22 formed in recessed bottom wall 24, which provides access to the interior 32 of dispenser 10. Orifice 22 preferably has an H-like configuration which is formed from a pair of elongate and substantially rectangular openings 22*a* extending generally parallel to one another and joined by a central opening 22*b*. A pair of flexible tab portions 22*c* are thereby formed between elongate openings 22*a* and central opening 22*b*.

A plurality of moisture-impregnated articles 60, such as moist tissues, towelettes, wipes, etc., are provided and are retained within housing 16 when manufacture of the dispenser is completed. The plurality of moisture-impregnated articles, hereinafter generically referred to as "moist tissues," are preferably interleaved to facilitate pop-up dispensing through orifice 22. The interleaving of the moist tissue allows a second, interleaved tissue to cling to the first tissue, primarily through frictional forces, as the first tissue is withdrawn from the dispenser. This second tissue is then frictionally retained in orifice 22 with an upper portion thereof extending outwardly from the orifice as shown in FIG. 1. The H-like shape of orifice 22 also facilitates pop-up dispensing of the moist tissues by frictionally engaging a top portion 64 of the next moist tissue 62 as a previous tissue is drawn from housing 12 through orifice 22. Although the orifice is preferably H-shaped, other shapes and arrangements may be used so as to allow a portion of the next dispensed moist tissue to be disposed within recessed portion 20 and frictionally engaged by orifice 22 for pop-up dispensing.

Although interleaving the individual tissues is preferred, other types of arrangements of tissues can be provided. For instance, the tissues can comprise a continuous web of material in which perforations are provided such that as the web is drawn from the container, an individual tissue will tear off, leaving behind a top portion of the web within recessed portion 20 held therein by the orifice for tear removal of the next tissue.

A resealable flexible label 50 is provided to completely cover recessed portion 20 and prevent the moist tissues from drying out. Label 50 includes an upper surface 51, a lower surface 52 and a lift tab 54. Label 50 is preferably made from a synthetic resin film or the like which is also capable of providing a high moisture vapor barrier, such as a vinyl film, a polyester film, or aluminum foil, or the like, and should be relatively strong and durable so as to allow the user to firmly pull back the label without tearing, deforming or otherwise damaging it upon multiple openings. Label 50 is provided with a width that is slightly larger than the width of recessed portion 20 and a length that is slightly larger than the length of recessed portion 20 so as to completely cover recessed portion 20 when label 50 is in its closed, sealed position. To maintain label 50 in a closed, sealed condition, lower surface 52 of label 50 is preferably provided with pressure-sensitive adhesive 53 to allow it to be peeled back from outer surface 18 when the dispenser is opened, and resealed to outer surface 18 when the label is closed. In its closed position, label 50 thereby provides a substantially liquid and gas impervious seal to prevent the drying out of the moisture-impregnated tissues. Adhesive may be applied to the entirety of lower surface 52 or may be provided only along the perimeter thereof. In addition, a base portion 58 of lower surface 52 at the end of the label opposite the lift tab 54, can be provided with a more permanent adhesive such that label 54 cannot be fully removed from outer surface 18 when the label is fully pulled back. Alternatively, other methods can be employed in order to permanently or semi-permanently attach the end of the label 50 to the outer surface 18. This could include heat sealing, separate fasteners, and the like. As for the other end of label 50 which includes lift tab 54, this position of the label is preferably entirely free of any adhesive. Furthermore, a slight depression can be molded into the outer surface 18 at the location of lift tab 54 in order to assist the user in initially grasping same.

As shown in FIG. 2, a thin flexible bottom sheet 40 is provided to seal opening 30 to the housing 12 assist in retaining the moist tissues once the plurality of moist tissues 60 are provided within interior 32 through opening 30. Preferably, bottom sheet 40 is made from one or more layers of thin synthetic resin film or other such moisture vapor barrier layer, including polyester, such as mylar film, as well as various vinyl materials, or aluminum foil and the like, which is also preferably recyclable. Bottom sheet 40 can, on the other hand, consist of a more rigid material, such as the materials from which the housing 20 is produced, as discussed above, or even more rigid thermoplastic materials, which can be affixed to the housing 20 by various means such as adhesives, heat-sealing, or a snap-on configuration. However, the flexible bottom sheet materials discussed above are preferred for a number of reasons. As one example is the fact that such flexible materials can be readily subjected to printing processes directly on the surface thereof, while with the more rigid materials this may not be possible. In that case, either embossing techniques or the application of printed labels becomes necessary, with a concomitant increase in cost.

Figure 5:
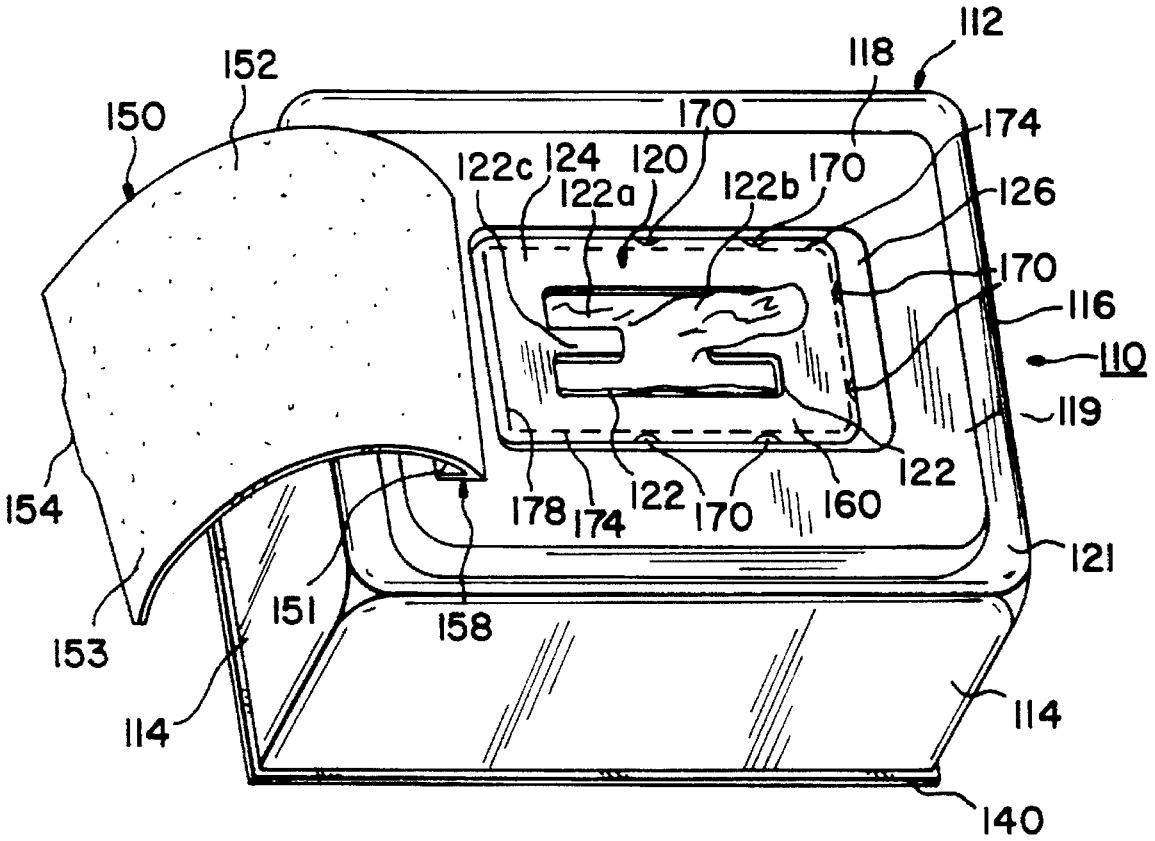
FIG. 5 is a top perspective view of a resealable dispenser in accordance with another embodiment of the present invention.

Another embodiment of the resealable dispenser of this invention is illustrated in FIG. 5. In connection with this embodiment, the reference numerals correspond to the reference numerals discussed above, except with an additional prefix of 100, i.e., such that the dispenser 10 previously shown is now dispenser 110, etc. Corresponding reference numerals to those in FIGS. 1 and 2 are thus also included in FIG. 5. In this case, however, the nature of recessed portion 120, which is still integrally formed in top wall 116, now includes a recessed bottom wall 124 which includes a die cut portion shown by the broken line in FIG. 5. Thus, at or near the intersection between recessed side walls 126 extending circumferentially about bottom wall 124, the top wall of the dispenser 110 is die cut so that the entire bottom wall portion 124 can be lifted out of recess 120 about a hinged portion 178 at the end of the recessed portion 120 adjacent to the resealable flexible label 150. In this case, the resealable flexible label 150 is slightly spaced from the recessed portion 120, so that it will not interfere with its functioning as a hinge for the bottom wall portion 124. It is also noted that, as shown in the embodiment of FIG. 5, the entire top wall 116 need not be on a single plane, but can include, for example, a raised portion 119 and a circumferentially extending rim portion 121, together forming top wall 116. In any event, projecting from the base of the side walls 126 towards the bottom wall 124 are a number of projections 170 extending inwardly therefrom. In this manner, the bottom wall portion 124 can be lifted, such as by placing the finger within the orifice 122, thus pulling the bottom wall portion 124 past projections 170 and hinged around hinged portion 178 to provide access to the inside of the dispenser itself. This may be required, for example, where the pop-up function does not operate properly, i.e., the next available moist tissue does not pop-up sufficiently to grasp the end thereof. Thus, access can be obtained to the wet tissues, the next available tissue can be manually grasped, and the recessed bottom wall portion 124 can then be replaced. This is carried out by merely reversing the rotation of bottom wall portion 124 around hinged portion 178, and then pushing the bottom wall 124 past projections 170 so the bottom wall snaps below the projections 170 and is held in place thereby. In all other respects, the embodiment of the resealable dispenser 110 is the same as that of the dispenser shown in FIGS. 1 and 2 hereof.

Figure 4:
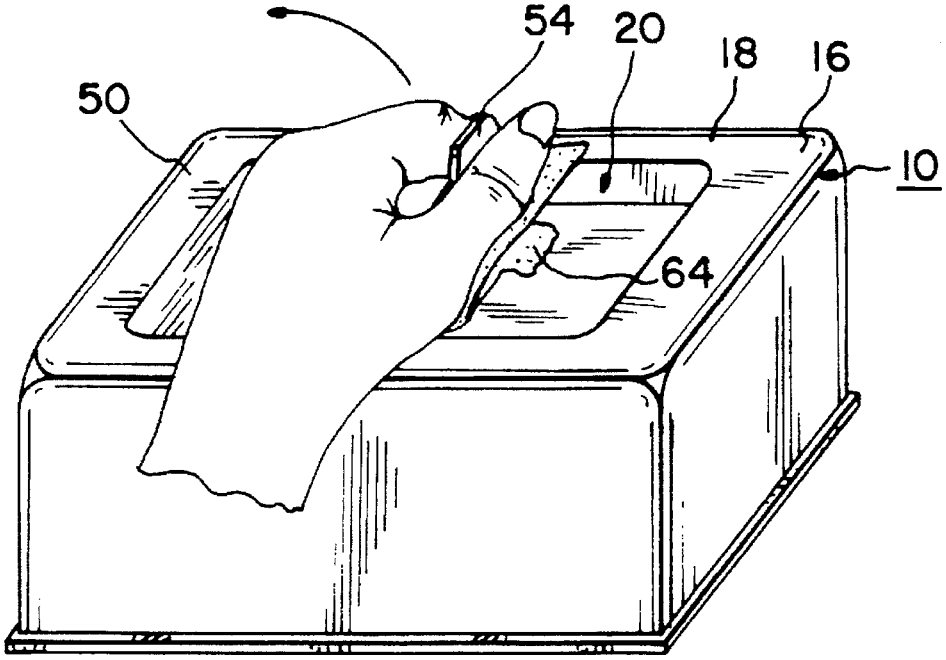
FIG. 4 is a front perspective view illustrating the further opening of the dispenser of FIG. 1 as it is initially opened.

The one-handed opening of the resealable dispenser is illustrated in FIGS. 3 and 4. First, as shown in FIG. 3, a hand is placed over the dispenser and rested on top wall 16. The lift tab 54 of label 50 is then grasped between the thumb and forefinger to begin opening the dispenser by peeling back label 50. As shown in FIG. 4, the side of the hand adjacent the little finger continues to rest on top wall 16 as the label is further peeled back as hand is rotated or pivoted counterclockwise to further peel back the label and reveal the recessed portion 20 and top portion 64 of the next moist tissue 62. The necessary leverage to peel back the label is achieved since the housing 12 is formed from a material with sufficient rigidity so that label pulls easily from the outer surface 18 of the top wall 16 and the housing is not crushed as the hand is pressed down on the dispenser and the label is peeled back. Once the label is peeled back to reveal recessed portion 20, moist tissues can be removed from the dispenser with one hand in a pop-up fashion as described above. Resealing label 50 is the easily accomplished by pressing down the label onto top wall 16.

The ease of one-handed opening and resealing provided by the present invention is typically not provided by resealable label dispensers formed with a thin, flexible film container. These thin film containers do not provide sufficient rigidity to the container, such as a rigid top wall, and thus one end of the container must be held with one hand while the other hand is used to peel back the label.

As explained above, the dispenser of the present invention is highly advantageous from a manufacturing standpoint since the recessed portion 20 is formed integrally with housing 12, i.e., side walls 14, outer surface 18, recess bottom wall 24 and recess side walls 26 are all integrally formed from the same material. This unitary arrangement of housing 12 eliminates the need to provide separate tray or well members to form a recess in the top wall for storing the top portion of the next moist tissue for pop-up dispensing. A preferred method of manufacturing the resealable dispenser is also provided.

Thus, to manufacture the dispenser in accordance with the present invention, the housing 12 is formed with standard techniques such as thermoforming or injection molding to form a unitary housing with depending side walls 14, and top wall 16 having outer surface 18 and recessed portion 20. Orifice 22 can be separately formed by an appropriately shaped punch or can be fashioned when housing 12 is formed.

Once the housing is formed, the interleaved moisture-impregnated articles 60 are then supplied to the housing through opening 30 in the housing and then sealed therein by flexible bottom sheet 40 by conventional techniques such as heat-sealing or adhesive fastening to provide an air-tight and water-tight seal. The resealable flexible label 50 is then attached to outer surface 18 of top wall 16 so as to completely cover recessed portion 20. Alternatively, label 50 can be attached to housing 20 before it is filled with the interleaved moisture-impregnated articles 60, and then the housing can be sealed with bottom sheet 40.

Accordingly, a resealable dispenser in accordance with the present invention provides a single container with all of the advantages of providing an resealable label, pop-up moist tissue dispenser which is inexpensive, disposable, recyclable, lightweight, easily constructed, and allows opening of the dispenser and removal of moist tissues with the use of only one hand. Moreover, from a retailer's perspective, precious shelf space can be freed up by providing the dispenser of the present invention which eliminates the need to stock and display both a reusable dispenser and refill packs, since the dispenser of the present invention serves both functions.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangement may be devised without departing from the spirit and scope of the present invention as set forth in the appended claims.

What is claimed is:

1. A resealable dispenser for dispensing individual moisture-impregnated articles from a plurality of interleaved said moisture-impregnated articles comprising:

a housing having sufficient rigidity to retain its shape subsequent to its manufacture, said housing including depending side wall means for retaining a supply of said moisture-impregnated articles therein and a top wall comprising a substantially planar outer surface and a recessed portion having a perimeter and including an orifice for removal of said individual moisture-impregnated articles from said housing through said orifice, said recessed portion having a size sufficient to accommodate a portion of one of said moisture-impregnated articles projecting from said orifice;

supply means comprising an opening in said housing for supplying a plurality of said moisture-impregnated articles into said housing subsequent to its manufacture;

sealing means for sealing said supply means after said supplying of said plurality of said moisture-impregnated articles into said housing; and a resealable flexible label attached to said substantially planar outer surface of said top wall of said housing and having a size greater than said perimeter of said recessed portion and sufficient to completely cover and extend beyond said perimeter of said recessed portion, whereby said moisture-impregnated articles can be individually removed from said housing and a subsequent one of said plurality of moisture-impregnated articles drawn into the removal position with a portion of said article within said recessed portion, and said resealable label can be resealably sealed to said outer surface of said top wall with said subsequent moisture-impregnated article in said removal position.

2. A dispenser as claimed in claim 1, wherein said top wall comprises a single layer.

3. A dispenser as claimed in claim 1, wherein said housing is formed from semi-rigid thermoplastic material.

4. A dispenser as claimed in claim 1, wherein said substantially planar outer surface comprises the entire top wall of said housing.

5. A dispenser as claimed in claim 3, wherein said thermoplastic material comprises polyolefins or polyimides.

6. A dispenser as claimed in claim 1, wherein said housing includes a bottom and said opening of said supply means is provided on said bottom of said housing.

7. A dispenser as claimed in claim 6, wherein said opening comprises the entirety of said bottom.

8. A dispenser as claimed in claim 1, wherein said sealing means comprises a thin film covering providing a bottom wall for said housing.

9. A dispenser as claimed in claim 1, wherein said recessed portion includes a base portion, and including access means for displacing said base portion and obtaining access to said housing.

10. A dispenser as claimed in claim 9, wherein said base portion is die-cut from a portion of said recessed portion.

11. A dispenser as claimed in claim 9, wherein said base portion is separable from said recessed portion, and said access means includes temporary locking means for temporarily locking said base portion in position in said recessed portion.

12. A dispenser as claimed in claim 11, wherein said temporary locking means comprises a plurality of projections extending from said side walls of said recessed portion.

13. A dispenser as claimed in claim 9, wherein said base portion is die-cut for a portion of said recessed portion, and said base portion includes an integral portion connecting said base portion with said recessed portion, said integral portion comprising said access means.

14. A dispenser as claimed in claim 13, wherein said access means includes temporarily locking means for temporarily locking said base portion in position in the said recessed portion.

15. A dispenser as claimed in claim 14, wherein said temporarily locking means comprises projections extending from said side walls of said recessed portion.

16. A method of manufacturing a resealable dispenser for dispensing individual moisture-impregnated articles from a plurality of interleaved said moisture-impregnated articles comprising the steps of:

(a) forming a housing including depending side walls and a top wall comprising a substantially planar outer surface and a recessed portion having a perimeter and including an orifice for removal of said individual moisture-impregnated articles from said housing through said orifice, said recessed portion having a size sufficient to accommodate a portion of one of said moisture-impregnated articles projecting from said orifice and said housing being formed from a material having sufficient rigidity so that said housing retains its shape subsequent to its formation;

(b) supplying said plurality of said moisture-impregnated articles to said housing through an opening in said housing subsequent to said step of forming said housing;

(c) sealing said opening in said housing after said step of supplying said plurality of said moisture-impregnated articles into said housing; and (d) attaching a resealable flexible label to said substantially planar outer surface of said top wall of said housing, said label having a size greater than said perimeter of said recessed portion and sufficient to completely cover and extend beyond said perimeter of said recessed portion, whereby said moisture-impregnated articles can be individually removed from said housing and a subsequent one of said plurality of moisture-impregnated articles drawn into the removal position with a portion of said article within said recessed portion, and said resealable label can be resealably sealed to said outer surface of said top wall with said subsequent moisture-impregnated article in said removal position.

17. A method as claimed in claim 16, including die-cutting a portion of said recessed portion whereby said portion of said recessed portion may be displaced to provide access to said housing.

18. A resealable dispenser for dispensing individual moisture-impregnated articles from a plurality of interleaved said moisture-impregnated articles comprising:

a housing having sufficient rigidity to retain its shape subsequent to its manufacture, said housing including depending side wall means for retaining a supply of said moisture-impregnated articles therein and a top wall comprising a substantially planar outer surface and a recessed portion including an orifice for removal of said individual moisture-impregnated articles from said housing through said orifice, said recessed portion having a size sufficient to accommodate a portion of one of said moisture-impregnated articles projecting from said orifice;

supply means comprising an opening in said housing for supplying a plurality of said moisture-impregnated articles into said housing subsequent to its manufacture;

sealing means for sealing said supply means after said supplying of said plurality of said moisture-impregnated articles into said housing, said sealing means comprising a thin film covering providing a bottom wall for said housing; and a resealable flexible label attached to said substantially planar outer surface of said top wall of said housing and having a size sufficient to completely cover said recessed portion, whereby said moisture-impregnated articles can be individually removed from said housing and a subsequent one of said plurality of moisture-impregnated articles drawn into the removal position with a portion of said article within said recessed portion, and said resealable label can be resealably sealed to said outer surface of said top wall with said subsequent moisture-impregnated article in said removal position.

19. A dispenser as claimed in claim 18, wherein said top wall comprises a single layer.

20. A dispenser as claimed in claim 18, wherein said housing is formed of semi-rigid thermoplastic material.

21. A dispenser as claimed in claim 18, wherein said substantially planar outer surface comprises the entire wall of said housing.

22. A dispenser as claimed in claim 18, wherein said housing includes a body and said opening of said supply means is provided on said bottom of said housing.

23. A dispenser as claimed in claim 22, wherein said opening comprises the entirety of said bottom.

24. A resealable dispenser for dispensing individual moisture-impregnated articles from a plurality of interleaved said moisture-impregnated articles comprising:

a housing having sufficient rigidity to retain its shape subsequent to its manufacture, said housing including depending side wall means for retaining a supply of said moisture-impregnated articles therein and a top wall comprising a substantially planar outer surface and a recessed portion including an orifice for removal of said individual moisture-impregnated articles from said housing through said orifice, said recessed portion having a size sufficient to accommodate a portion of one of said moisture-impregnated articles projecting from said orifice, and including a base portion, and access means for displacing said base portion and obtaining access to said housing;

supply means comprising an opening in said housing for supplying a plurality of said moisture-impregnated articles into said housing subsequent to its manufacture;

sealing means for sealing said supply means after said supplying of said plurality of said moisture-impregnated articles into said housing; and a resealable flexible label attached to said substantially planar outer surface of said top wall of said housing and having a size sufficient to completely cover said recessed portion, whereby said moisture-impregnated articles can be individually removed from said housing and a subsequent one of said plurality of moisture-impregnated articles drawn into the removal position with a portion of said article within said recessed portion, and said resealable label can be resealably sealed to said outer surface of said top wall with said subsequent moisture-impregnated article in said removal position.

25. A dispenser as claimed in claim 24, wherein said base portion is die-cut from a portion of said recessed portion.

26. A dispenser as claimed in claim 24, wherein said base portion is separable from said recessed portion, and said access means includes temporary locking means for temporarily locking said base portion in position in said recessed portion.

27. A dispenser as claimed in claim 26, wherein said temporary locking means comprises a plurality of projections extending from said side walls of said recessed portion.

28. A dispenser as claimed in claim 24, wherein said base portion is dye-cut for a portion of said recessed portion, and said base portion includes an integral portion connection said base portion with said recessed portion, said integral portion comprising said access means.

29. A dispenser as claimed in claim 28, wherein said access means includes temporary locking means for temporarily locking the base portion in position in said recessed portion.

30. A dispenser as claimed in claim 29, wherein said temporary locking means comprises projections extending from said side walls of said recessed portion.

31. A method of manufacturing a resealable dispenser for dispensing individual moisture-impregnated articles from a plurality of interleaved said moisture-impregnated articles comprising the steps of:

(a) forming a housing including depending side walls and a top wall comprising a substantially planar outer surface and a recessed portion including an orifice for removal of said individual moisture-impregnated articles from said housing through said orifice, said recessed portion having a size sufficient to accommodate a portion of one of said moisture-impregnated articles projecting from said orifice and said housing being formed from a material having sufficient rigidity so that said housing retains its shape subsequent to its formation;

(b) dye-cutting a portion of said recessed portion whereby said portion of said recessed portion may be displaced to provide access to said housing;

(c) supplying said plurality of said moisture-impregnated articles to said housing through an opening in said housing subsequent to said step of forming said housing;

(d) sealing said opening in said housing after said step of supplying said plurality of said moisture-impregnated articles into said housing; and (e) attaching a resealable flexible label to said substantially planar outer surface of said top wall of said housing, said label having a size sufficient to completely cover said recessed portion, whereby said moisture-impregnated articles can be individually removed from said housing and a subsequent one of said plurality of moisture-impregnated articles drawn into the removal position with a portion of said article within said recessed portion, and said resealable label can be resealably sealed to said outer surface of said top wall with said subsequent moisture-impregnated article in said removal position.

* * * * *

UNITED STATES PATENT AND TRADEMARK OFFICE

CERTIFICATE OF CORRECTION

PATENT NO. : 5,647,506

DATED : July 15, 1997

INVENTOR(S) : Robert P. Julius

It is certified that error appears in the above-identified patent and that said Letters Patent is hereby corrected as shown below:

Column 2, line 11, delete "be".
Column 2, line 19, "with in" should read --within--.
Column 3, line 1, delete "form" and insert therefor --from--.
Column 4, line 23, following "bottom" insert --of--.
Column 8, line 16, delete "the".
Column 8, line 58, delete "an" and insert therefor --a--.
Column 10, line 8, delete "for" and insert therefor --from--.
Column 12, line 18, delete "dye-cut for" and insert therefor --die-cut from--.
Column 12, line 19, "connection" should read --connecting--.
Column 12, line 43, delete "dye" and insert therefor --die--.

Signed and Sealed this

Seventh Day of October, 1997

*Attest:*

Bruce Lehman

BRUCE LEHMAN

*Attesting Officer*

*Commissioner of Patents and Trademarks*